US009872803B2

(12) United States Patent
Rugfelt

(10) Patent No.: US 9,872,803 B2
(45) Date of Patent: Jan. 23, 2018

(54) TRANSPORT DEVICE INCLUDING A FLEXIBLE BASE PLATE

(71) Applicant: KOHLBRAT & BUNZ GESELLSCHAFT M.B.H., Radstadt (AT)

(72) Inventor: Haakan Rugfelt, Falsterbo (SE)

(73) Assignee: Kohlbrat &Bunz Gesellschaft M.B.H., Radstadt (AT)

( * ) Notice: Subject to any disclaimer, the term of this patent is extended or adjusted under 35 U.S.C. 154(b) by 0 days.

(21) Appl. No.: 15/089,925

(22) Filed: Apr. 4, 2016

(65) Prior Publication Data

US 2016/0242974 A1 Aug. 25, 2016

Related U.S. Application Data

(63) Continuation of application No. PCT/AT2014/000180, filed on Oct. 2, 2014.

(30) Foreign Application Priority Data

Oct. 4, 2013 (AT) ..... A 768/2013

(51) Int. Cl.

| | |
|---|---|
| ***A61G 1/00*** | (2006.01) |
| ***A61G 1/013*** | (2006.01) |
| ***A61G 1/01*** | (2006.01) |
| *A61G 1/044* | (2006.01) |
| *A61G 1/048* | (2006.01) |

(52) U.S. Cl.

CPC ..... *A61G 1/013* (2013.01); *A61G 1/01* (2013.01); *A61G 1/044* (2013.01); *A61G 1/048* (2013.01)

(58) Field of Classification Search

CPC ..... A61G 1/00
USPC ..... 5/625–629; 244/137.2
See application file for complete search history.

(56) References Cited

U.S. PATENT DOCUMENTS

| | | | | |
|---|---|---|---|---|
| 5,333,335 | A | 8/1994 | Gastle et al. | |
| 5,424,107 | A | 6/1995 | Lee | |
| 6,124,017 | A | 9/2000 | Sokol, Jr. et al. | |
| 6,469,378 | B2 | 10/2002 | Scheuermann | |
| 2008/0178383 | A1* | 7/2008 | Jordan | A61G 1/00 5/89.1 |
| 2014/0053335 | A1* | 2/2014 | Calkin | A61G 1/044 5/628 |

FOREIGN PATENT DOCUMENTS

| | | | |
|---|---|---|---|
| AT | 511211 | A4 | 10/2012 |
| CN | 201384651 | Y | 1/2010 |
| CN | 202960962 | U | 6/2013 |

(Continued)

*Primary Examiner* — Fredrick Conley
(74) *Attorney, Agent, or Firm* — Laurence A. Greenberg; Werner H. Stemer; Ralph E. Locher

(57) ABSTRACT

A transport device includes a flexible base plate which is rolled up when not in use and is spread out flat to receive a load to be transported and is raised at least at the longitudinal sides when in use. The transport device has holes for the attachment of straps or belts at least along two longitudinal edges of the base plate. Reinforcing elements each include two plates fixed to the base plate on both sides by an eyelet and two further fastening elements associated with the holes. The eyelet borders the hole for attachment of the strap or belt. The eyelet and the two further fastening elements are disposed in a triangle.

7 Claims, 3 Drawing Sheets

(56) References Cited

FOREIGN PATENT DOCUMENTS

| | | | |
|---|---|---|---|
| DE | 4336342 | A1 | 11/1994 |
| DE | 19501225 | A1 | 7/1996 |
| FR | 2465475 | A1 | 3/1981 |
| GB | 2409809 | A | 7/2005 |
| JP | 3176927 | U | 6/2012 |
| WO | 2012171050 | A1 | 12/2012 |

* cited by examiner

TRANSPORT DEVICE INCLUDING A FLEXIBLE BASE PLATE

CROSS-REFERENCE TO RELATED APPLICATION

This is a continuation application, under 35 U.S.C. § 120, of copending International Application PCT/AT2014/000180, filed Oct. 2, 2014, which designated the United States; this application also claims the priority, under 35 U.S.C. §119, of Austrian Patent Application AT A 768/2013, filed Oct. 4, 2013; the prior applications are herewith incorporated by reference in their entirety.

BACKGROUND OF THE INVENTION

Field of the Invention

The invention relates to a transport device including a flexible base plate which is rolled up when not in use, which is spread out flat to receive a load to be transported and which is raised at least at the longitudinal sides when in use, resulting in an approximately U-shaped cross section. Holes are provided at least along the two longitudinal edges of the base plate. The holes are associated with reinforcing elements which are each fixed by an eyelet and further fastening elements to the base plate. The eyelet borders or encloses a hole in the base plate for attachment of a strap or the like.

Such a transport device is known, for example, from Austrian Patent transport device which has, for example, a 2 mm to 3 mm-thick base plate made of a polyethylene or the like, is preferably rolled up when not in use and stored in a carrier bag or the like. The laden transport device can be pulled on the ground, particularly in difficult terrain, and can also be transported by using a helicopter due to straps which can be suspended in the holes along the longitudinal edge. The holes are reinforced by individual eyelets or brackets, the brackets extending perpendicular to the longitudinal edge, having an opening aligned with a hole and being riveted to the base plate in the region adjoining the opening. Such reinforcing brackets made of a stainless steel, with a 2 mm thickness, achieve a tear-out strength of approximately 600 daN for the holes receiving the straps. The holes are situated behind one another in the pulling direction, with the result that the tear-out strength of each rivet is codetermined not by its spacing from the longitudinal edge of the base plate but by its spacing from the hole situated in front.

SUMMARY OF THE INVENTION

It is accordingly an object of the invention to provide a transport device including a flexible base plate, which overcomes the hereinafore-mentioned disadvantages of the heretofore-known devices of this general type and which further improves the tear-out strength of holes close to edges for such a transport device without loss or impairment of the above-described properties.

With the foregoing and other objects in view there is provided, in accordance with the invention, a transport device comprising a flexible base plate which is rolled up when not in use, which is spread out flat to receive a load to be transported and which in use is raised at least at the longitudinal side, with the result that it has an approximately U-shaped cross section, wherein holes are provided at least along the two longitudinal edges of the base plate, which holes are assigned reinforcing elements which are each fixed by an eyelet and further fastening elements to the base plate, wherein the eyelet encloses a hole in the base plate for attachment of a strap or the like. The transport device achieves the object mentioned above in that each reinforcing element includes two plates which are provided on both sides of the base plate and fixed by an eyelet and two further fastening elements in regions disposed in a triangle. The fastening points disposed in a triangle are not disposed rectilinearly behind one another, and the above-described disadvantage is consequently avoided.

The attachment of plates to the outer side of a base plate which is bent up in a U-shape when in use does not, as has been found out, contradict the task of providing a transport device which can also be pulled on the ground since the plates provided on the outer side are disposed exclusively in the raised surroundings of the load-bearing surface that can not normally come into contact with the ground below, that is to say they are outside any region of the base plate that slides on the ground and furthermore are smooth and without projection. The plates also do not prevent the base plate from being rolled up in the longitudinal direction since they are each provided at a sufficient spacing from one another.

In accordance with another feature of the invention, a particularly advantageous distribution or introduction of forces is obtained particularly in an embodiment in which the region provided with the eyelet is closest to the longitudinal edge of the base plate, with the result that the two further fastening elements are spaced further apart from the longitudinal edge. Each further fastening element may, for example, be a rivet, but it is preferably likewise an eyelet enclosing or bordering a hole. Particularly in this case there is consequently obtained the advantageous configuration that the two holes further remote from the longitudinal edge of the base plate are suitable for guiding through fastening elements for supplementary parts. These supplementary parts may be of any desired kind, for example handles, a frame of a chassis, or the like.

The plates are preferably formed of an equilateral triangle, but can also be isosceles or right-angled, which may be of advantage for attachment to edge transition zones in the case of base plates which are not rectangular but cut obliquely at the four corners. Other shapes for the plates, for example round ones, are conceivable. A rectangular element can preferably also be bent into a U shape and be plugged in a straddling manner onto the longitudinal edge of the base plate, with the two legs of the U shape forming the plates.

In accordance with a concomitant preferred feature of the invention, which is especially suitable for the transport of injured persons, the transverse edges of the base plate are also raised and form a length delimitation in the form of a head or foot part. In order to attach straps or other fastening elements, holes close to the edges are preferably also provided in the head or foot part, which holes are assigned plates on both sides that are fixed to the base plate by fastening elements disposed in a triangle.

The plates are preferably made of 0.5 to 1 mm thick steel sheet, with the described equilateral triangle steel sheet plates achieving a tear-out strength of the hole of up to 1000 daN and more. The tear-out strength is thus approximately double the values indicated for the prior art.

Other features which are considered as characteristic for the invention are set forth in the appended claims.

Although the invention is illustrated and described herein as embodied in a transport device including a flexible base plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
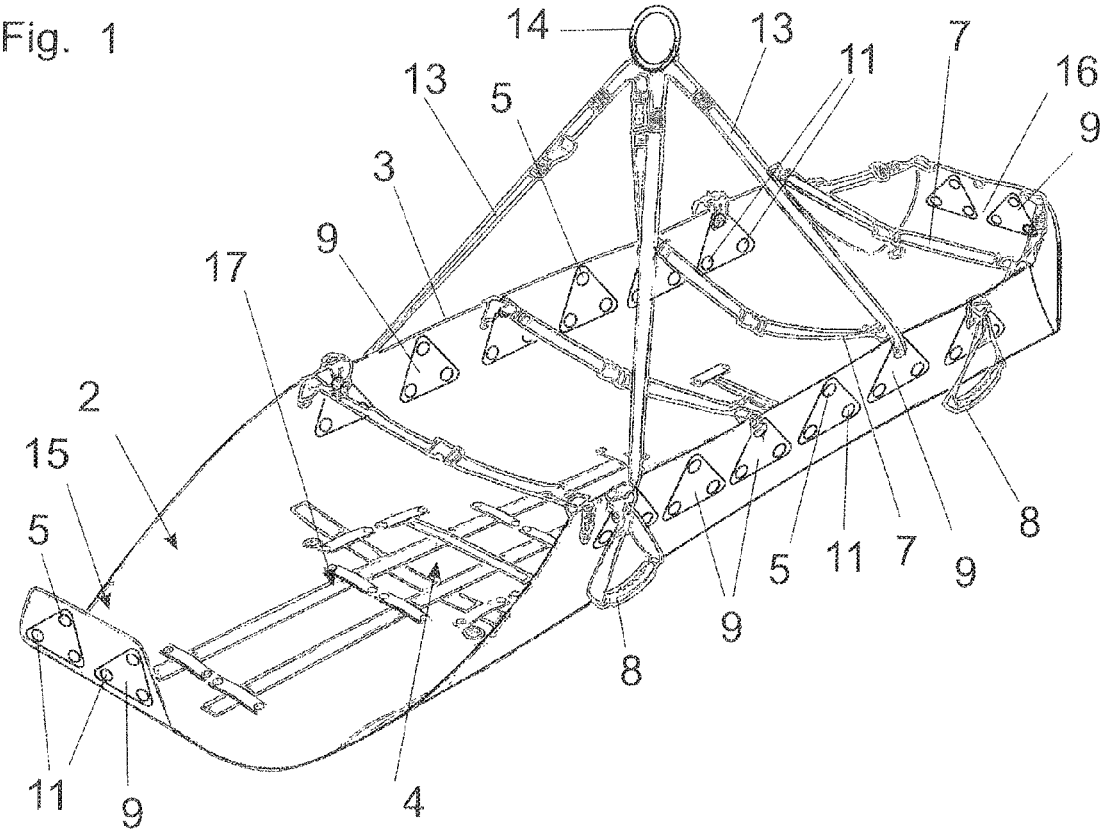
FIG. 1 is a diagrammatic, perspective view of a transport device in a position for horizontal transport.

Referring now to the figures of the drawings in detail and first, particularly, to FIG. 1 thereof, there is seen a spread-out base plate 2 of a transport device, which can be rolled up for empty transport when not in use and fixed by a band or the like. As can be seen in the figure, the transport device also has all of its important parts and auxiliaries on an inner side and reinforcing elements along longitudinal edges 3 and transverse edges of a head or foot region 15, 16 on the outer side because on those edges they do not come into contact with the ground below when the transport device is in use since all of the edge regions 3, 15, 16 are bent up.

Figure 2:
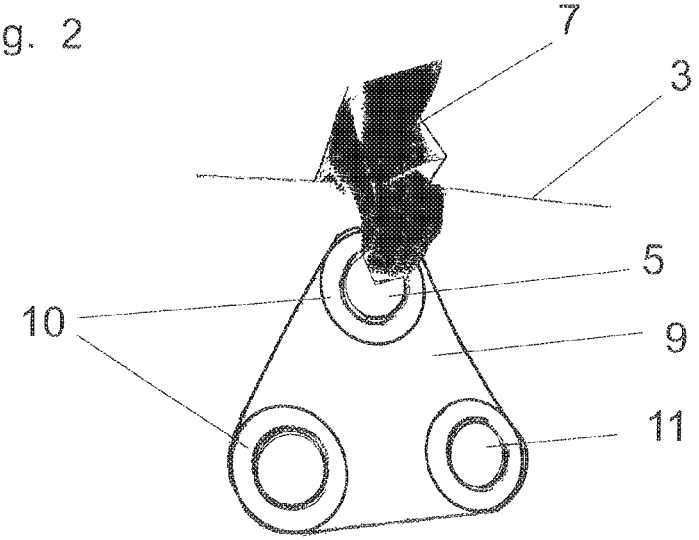
FIG. 2 is an enlarged detail of a reinforcing element.

Specifically, holes 5 are formed on the base plate 2 along the longitudinal edges 3 in order to receive straps or fasteners 7, 8 for securing an injured person and for horizontal transport by hand, and in order to receive straps 13 for helicopter transport. Especially the holes 5 for receiving the straps 13 for helicopter transport are assigned reinforcing elements. The reinforcing elements each include two plates 9 made of metal, for example of an aluminum alloy or a stainless steel, which each have an opening aligned with the hole 5 in the base plate 3. An eyelet 10 is inserted into the hole 5 and into the openings in both plates 9, with the result that the straps 7, 8, 13 can be guided through the holes 5 or linked therein, as is illustrated in FIG. 2. The plates 9 can be fixed, for example, by using rivets or the like in two other fastening regions thereof which are disposed in a triangle. The plates 9 of the reinforcing elements are attached on the outer side and the inner side of the base plate and each are preferably in the form of an equilateral triangle with rounded corners and are spaced apart from one another in the longitudinal direction in such a way that the base plate 2 can be rolled up without difficulties when not in use.

Figure 3:
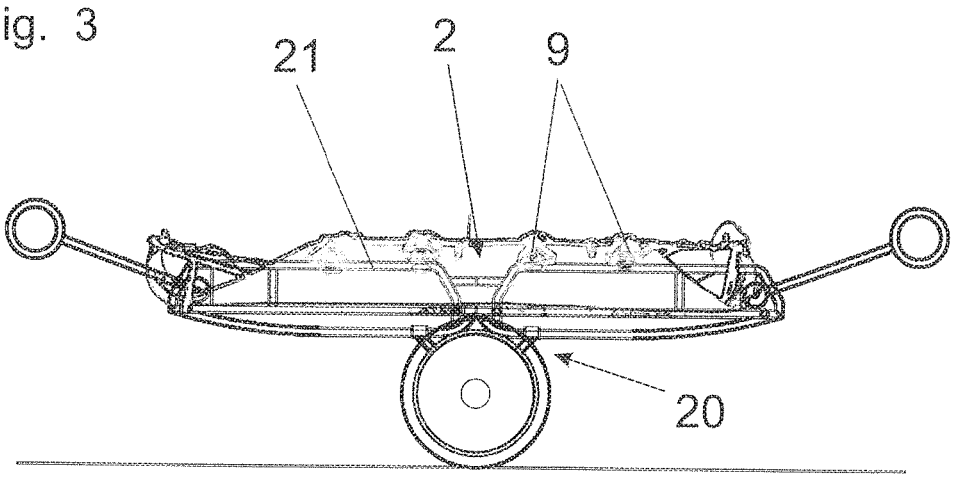
FIG. 3 is a side-elevational view of the transport device on a chassis.

FIG. 1 shows six reinforcing elements on each respective side whereas four can be seen on each respective side in FIG. 3. At least two per side are necessary in order to form four reinforced lifting points. The number can thus vary.

The holes 5 in the base plate 3 that are aligned only with eyelets have a tear strength of on average 200 to 250 daN. When reinforced with a bracket made of an aluminum alloy or of the same plastic as the base plate 2, approximately double the tear strength is achieved. If the reinforcing elements are fabricated from a stainless steel and attached in the form of the plates 9 on both sides of the base plate 2, it is thus possible to achieve tear-out strengths up to 1200 daN, which corresponds approximately to 8 times the maximum load to be transported.

Figure 4:
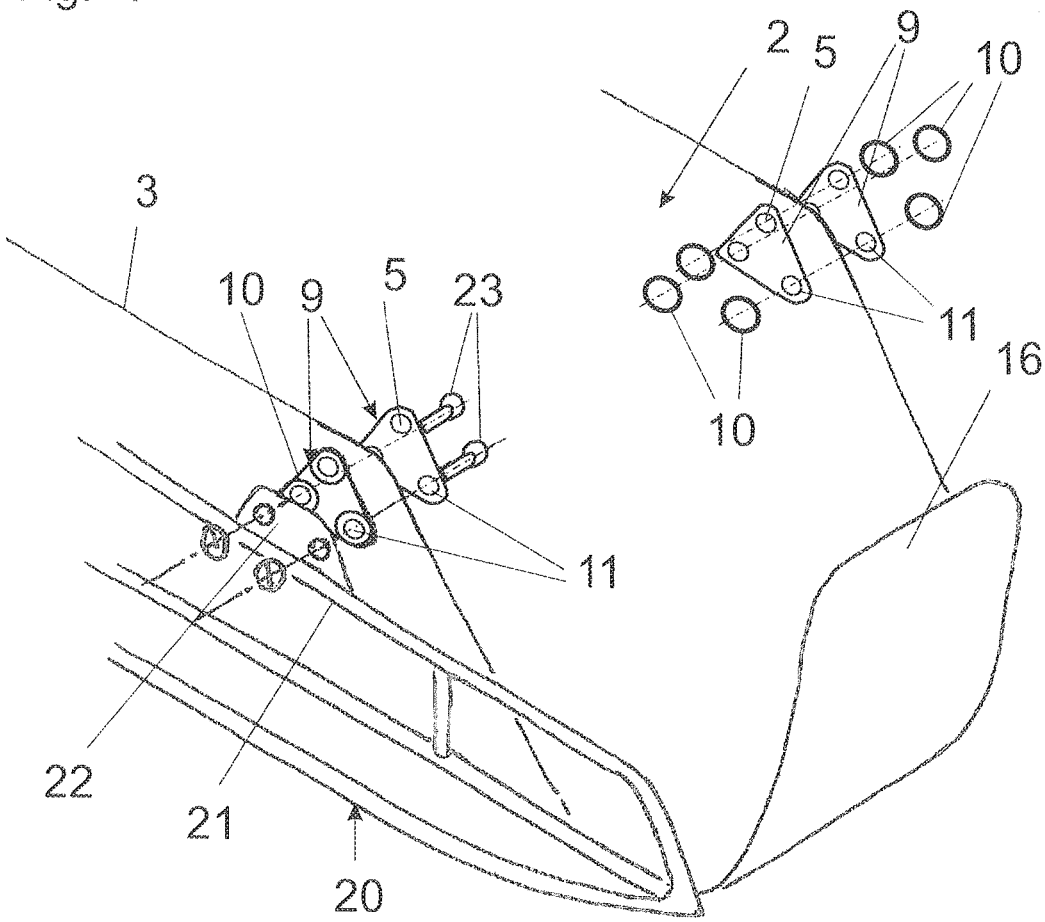
FIG. 4 is an enlarged, exploded, perspective view of a connection between a base plate provided with a reinforcing element and a lateral plane part.

The plates 9 which preferably have a triangular shape have one corner pointing toward the longitudinal edge 3 and the opposite side is therefore situated further away approximately parallel to the edge. Two further holes 11 are provided in the two other rounded corners of the two plates 9 and may also have further holes in the base plate 2 corresponding with them. Eyelets 10 are then, instead of rivets, preferably likewise provided as further connection elements in these regions too (FIGS. 2 and 4). As a result, it is possible with the aid of fastening elements 23, for example screws indicated on the left in FIG. 4, for supplementary parts 20 to be fastened to the base plate 2 in a simple manner. FIG. 3 shows a supplementary part 20 which is constructed as a single-axle, preferably single-track chassis and is provided with lateral frames 21 which can be mounted on the outer side of the base plate 2 in the raised edge region. The frame 21 has a respective bracket 22 (FIG. 4) for each fastening point. The bracket can be connected to the base plate 2 by using the fastening elements 23.

The right side of FIG. 4 shows the individual parts of a reinforcing element, namely the two plates 9 each having three holes disposed in a triangle and two halves of each of the three eyelets 10, which are to be pressed together.

Figure 5:
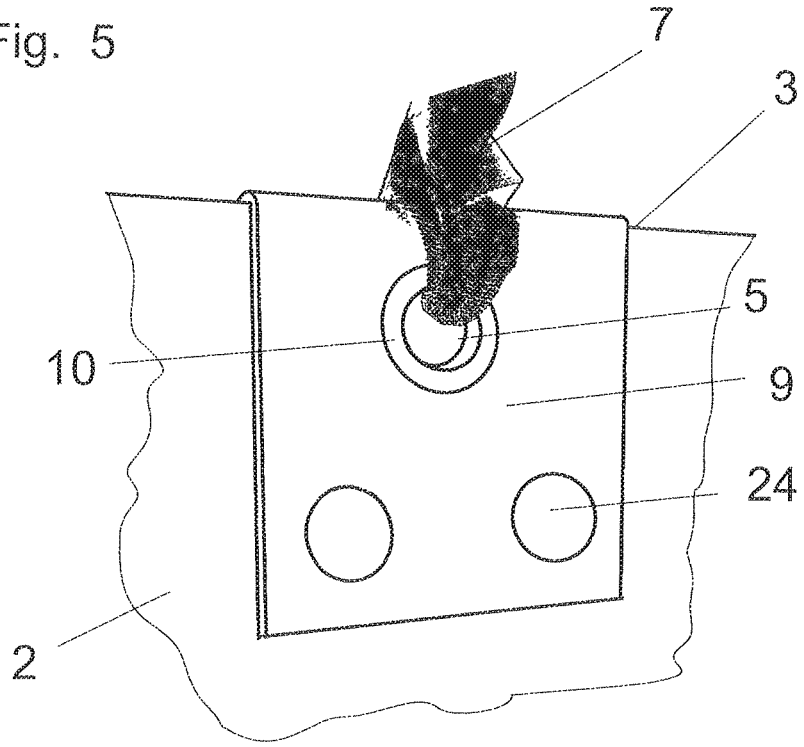
FIG. 5 is an enlarged detail similar to FIG. 2 with a modified configuration of the reinforcing element.

FIG. 5 shows a variant of the reinforcing element. In this embodiment, the two plates 9 are combined to form a one-piece element, bent over and placed in a straddling manner on the longitudinal edge 3. The holes 5 and the two further fastening elements are again disposed in a triangle, with the further fastening elements being formed by rivets 24 in this illustration.

The base plate 2 can likewise be bent up in the head and/or foot region 15, 16 in order to close a space and can likewise be provided with holes 5 at those locations. The holes 5 in the head region 15 can be used for suspension during vertical transport on a rescue rope or the like. These holes are also preferably assigned plates 9 fixed to the base plate on both sides thereof since those plates do not contact the ground during pulling.

A bearing surface 4 for the injured person has a series of stiffening elements 17 which are disposed in the region of the upper body and which extend in the longitudinal direction and in the transverse direction in order to prevent the ribcage of the injured person from being squashed during lifting. At least the elements 17 which extend in the longitudinal direction can be removed before rolling up.

The invention claimed is:

1. A transport device, comprising:

a flexible base plate being rolled up when not in use and being spread out flat to receive a load to be transported, said base plate having an inner side, an outer side and two longitudinal edges, said base plate being raised at least at said two longitudinal edges when in use resulting in an approximately U-shaped cross section, and said base plate having holes provided at least along said two longitudinal edges;

triangular reinforcing elements each having three corners, a respective hole in each of said corners and a respective eyelet bordering each of said holes, said holes in said reinforcing elements each being associated with a respective one of said holes in said base plate;

said eyelets fixing said reinforcing elements to said base plate, one of said eyelets bordering one of said holes in said base plate closest to said longitudinal edge of said base plate being configured for attachment of a strap or fastener; and each of said reinforcing elements including two plates each being disposed on a respective one of said inner and outer sides of said base plate and being fixed by said eyelets in said corners.

2. The transport device according to claim 1, wherein each of said reinforcing elements includes an intermediate piece interconnecting said two plates, being bent in a U shape and being placed in a straddling manner on said longitudinal edge.

3. The transport device according to claim 1, wherein said two plates are formed as separate components.

4. The transport device according to claim 1, wherein two others of said eyelets are further remote from said longitudinal edge of said base plate than said one eyelet being closest to said longitudinal edge of said base plate, and supplementary parts are held by said two other eyelets.

5. The transport device according to claim 4, wherein said supplementary parts are handles or frames of a chassis.

6. The transport device according to claim 1, wherein said base plate has two transverse edges, at least one of said transverse edges is provided with holes, two other plates are each disposed on a respective one of said inner and outer sides of said base plate at least at one of said transverse edges, and eyelets border said holes in said at least one transverse edge and fix said other plates.

7. The transport device according to claim 1, wherein said plates are made of steel sheet.

* * * * *